US010947988B2

(12) United States Patent
Yanagisawa et al.

(10) Patent No.: US 10,947,988 B2
(45) Date of Patent: Mar. 16, 2021

(54) IMPELLER AND CENTRIFUGAL COMPRESSOR

(71) Applicant: MITSUBISHI HEAVY INDUSTRIES COMPRESSOR CORPORATION, Tokyo (JP)

(72) Inventors: Shin Yanagisawa, Tokyo (JP); Nobuyori Yagi, Tokyo (JP); Jo Masutani, Tokyo (JP); Kazuki Chiba, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 52 days.

(21) Appl. No.: 15/562,199

(22) PCT Filed: Oct. 26, 2015

(86) PCT No.: PCT/JP2015/080075
§ 371 (c)(1),
(2) Date: Sep. 27, 2017

(87) PCT Pub. No.: WO2016/157584
PCT Pub. Date: Oct. 6, 2016

(65) Prior Publication Data

US 2018/0058468 A1 Mar. 1, 2018

(30) Foreign Application Priority Data

Mar. 30, 2015 (JP) ..... JP2015-070236

(51) Int. Cl.
*F04D 29/44* (2006.01)
*F04D 29/30* (2006.01)
(Continued)

(52) U.S. Cl.
CPC ..... *F04D 29/30* (2013.01); *F04D 29/284* (2013.01); *F04D 29/053* (2013.01); *F04D 29/4206* (2013.01)

(58) Field of Classification Search
CPC ..... F04D 29/30; F04D 29/284; F04D 29/053; F04D 29/4206; F05D 2240/301
(Continued)

(56) References Cited

U.S. PATENT DOCUMENTS 2,484,554 A * 10/1949 Concordia ..... F04D 29/30 416/188
3,904,308 A * 9/1975 Ribaud ..... F04D 21/00 415/143
(Continued)

FOREIGN PATENT DOCUMENTS

CN 203770209 U 8/2014
DE 10200951 A1 8/2003
(Continued)

OTHER PUBLICATIONS

International Search Report for corresponding International Application No. PCT/JP2015/080075, dated Dec. 22, 2015 (4 pages).
(Continued)

*Primary Examiner* — Hung Q Nguyen
*Assistant Examiner* — Anthony Donald Taylor, Jr.
(74) *Attorney, Agent, or Firm* — Osha Bergman Watanabe & Burton LLP

(57) ABSTRACT

An impeller includes a disk formed in a disk shape about an axis, and a plurality of blades provided at intervals in a circumferential direction on one side in the axial direction of the disk. The blades define a flow path extending from one side in the axial direction toward a radial outer side and include a low-rigidity region and a high-rigidity region. The low-rigidity region has an inlet, an outlet of the extending
(Continued)

region of the flow path, a relatively small plate thickness, and has a relatively small inclination angle with respect to the disk. The high-rigidity region adjacent to the low-rigidity region has a relatively large plate thickness, and a relatively large inclination angle with respect to the disk.

7 Claims, 6 Drawing Sheets

(51) Int. Cl.
*F04D 29/28* (2006.01)
*F04D 29/053* (2006.01)
*F04D 29/42* (2006.01)

(58) Field of Classification Search
USPC ..... 415/206
See application file for complete search history.

(56) References Cited

U.S. PATENT DOCUMENTS 4,093,401 A * 6/1978 Gravelle ..... F04D 29/284 415/143
4,275,988 A * 6/1981 Kalashnikov ..... B01F 7/081 415/143
4,502,837 A * 3/1985 Blair ..... F01D 5/045 415/198.1
4,653,976 A * 3/1987 Blair ..... F01D 5/045 415/1
5,112,195 A * 5/1992 Cox ..... F01D 5/048 416/179
5,685,696 A * 11/1997 Zangeneh ..... F01D 5/048 416/186 R
5,730,582 A * 3/1998 Heitmann ..... B63H 11/08 416/185
6,340,291 B1 * 1/2002 Reckert ..... F04D 29/284 416/185
6,419,450 B1 * 7/2002 Lum ..... F04D 29/2222 415/131
7,563,074 B2 * 7/2009 Xu ..... F04D 29/284 415/173.1
8,308,420 B2 * 11/2012 Yagi ..... F04D 29/30 415/1
8,475,131 B2 * 7/2013 Shibata ..... F04D 29/284 416/182
8,864,454 B2 * 10/2014 Hofer ..... F04D 17/12 415/181
2005/0260074 A1 * 11/2005 Higashimori ..... F04D 21/00 415/206
2011/0173975 A1 * 7/2011 Sun ..... F02B 47/08 60/605.2
2011/0318188 A1 * 12/2011 Billotey ..... F01D 5/048 416/223 A
2012/0051933 A1 * 3/2012 Hofer ..... F04D 21/00 416/223 R
2012/0263599 A1 * 10/2012 Sugimura ..... F04D 29/284 416/223 A
2014/0314557 A1 * 10/2014 Hiradate ..... F04D 29/284 415/203
2015/0159670 A1 * 6/2015 Saito ..... F04D 29/30 415/206

FOREIGN PATENT DOCUMENTS

EP 1 048 850 A1 11/2000
JP S63-085296 A 4/1988
JP H09-112286 A 4/1997
JP 2003-206892 A 7/2003
JP 2009-243394 A 10/2009
JP 2012-520412 A 9/2012
JP 2012-219779 A 11/2012
JP 2013-002280 A 1/2013
JP 2013-040587 A 2/2013
JP 2013-104417 A 5/2013
JP 2014-092138 A 5/2014
WO 99/36701 A1 7/1999

OTHER PUBLICATIONS

Written Opinion for corresponding International Application No. PCT/JP2015/080075, dated Dec. 22, 2015 (10 pages).

* cited by examiner

IMPELLER AND CENTRIFUGAL COMPRESSOR

TECHNICAL FIELD

The present invention relates to an impeller and a centrifugal compressor including the impeller.

Priority is claimed on Japanese Patent Application No. 2015-070236, filed Mar. 30, 2015, the content of which is incorporated herein by reference.

BACKGROUND ART

In general, a centrifugal compressor includes an impeller having a plurality of blades radially extending around a rotating shaft and a casing which covers the impeller from the outside and thereby defines a flow path with the impeller. The flow path suctions an external fluid into the casing by rotation of the impeller, applies pressure to the fluid while it flows through the flow path, and discharges the fluid at a high pressure from an outlet of the casing.

In such a centrifugal compressor as described above, a high pressure fluid and a low pressure fluid are mixed, particularly, before and after the impeller. It is known that bending stress is applied to the blades on the impeller due to a pressure difference between the fluids.

Therefore, various technologies have been proposed so far for the purpose of enhancing a rigidity opposing the bending stress. As one example of such a technology, one described in Patent Literature 1 below is known. In the centrifugal compressor described in Patent Literature 1, a thickness of at least one of an inlet side and an outlet side of the impeller is formed to be thick.

CITATION LIST

Patent Literature

[Patent Literature 1]

Japanese Unexamined Patent Application, First Publication No. 2009-243394

Incidentally, in a centrifugal compressor, it is known that the compression performance is affected when a thickness of a blade is increased. Particularly, the compression performance is significantly affected when a thickness of the blade on an outlet side of an impeller is increased. Also, due to a weight increase of the impeller, vibration characteristics are also affected. Therefore, there is room for improvement in the centrifugal compressor and the impeller of Patent Literature 1 described above.

SUMMARY OF INVENTION

One or more embodiments of the present invention provide an impeller and a centrifugal compressor that have improved rigidity and compression performance.

According to a first aspect of the present invention, an impeller includes a disk formed in a disk shape about an axis and a plurality of blades provided at intervals in a circumferential direction on one side in the axial direction of the disk and configured to define a flow path extending from one side in the axial direction toward a radial outer side, wherein the blades include a low-rigidity region which includes at least one of an inlet and an outlet of the extending region of the flow path, has a relatively small plate thickness, and has a relatively small inclination angle with respect to the disk and a high-rigidity region adjacent to the low-rigidity region, having a relatively large plate thickness, and having a relatively large inclination angle with respect to the disk.

According to one or more embodiments of the configuration described above, in the high-rigidity region of the blades, the plate thickness is set to be relatively large and the inclination angle with respect to the disk is set to be relatively large. That is, the plate thickness and the inclination angle change over the entire extending region of the flow path. Thereby, it is possible to further enhance the rigidity in a state in which the plate thickness is made relatively thin, for example, as compared with a configuration in which only the plate thickness is increased. Further, according to the configuration described above, a rigidity difference is generated between the high-rigidity region and the low-rigidity region. Due to the difference in rigidity, when bending stress is applied to the blades, most of the bending stress can be received in the high-rigidity region.

According to a second aspect of the present invention, in the impeller according to the first aspect, the high-rigidity region may be a central portion between the inlet and the outlet in the extending region of the flow path.

According to one or more embodiments of the configuration described above, it is possible to increase the rigidity of the central portion in the extending region of the flow path. Thereby, most of the bending stress applied to the blades can be received by the central portion.

According to a third aspect of the present invention, in the impeller according to the first or second aspect, curvature in a radial direction of the axis may be configured to be relatively small in the low-rigidity region and curvature in the radial direction of the axis may be configured to be relatively large in the high-rigidity region.

Here, according to one or more embodiments, the rigidity of the blades against the bending stress decreases as the curvature decreases, and increases as the curvature increases. Therefore, according to the configuration described above, it is possible to form the high-rigidity region and the low-rigidity region on the basis of the magnitude of the curvature. Thereby, it is possible to enhance the rigidity without increasing the plate thickness of the blades.

According to a fourth aspect of the present invention, the impeller according to any one of the first to third aspects may include a cover which covers the plurality of blades from one side in the axial direction.

According to one or more embodiments of the configuration described above, the blades are supported from both sides in the axial direction by the disk and the cover. Thereby, the rigidity of the blades can be further enhanced.

According to a fifth aspect of the present invention, a centrifugal compressor includes a rotating shaft configured to rotate about an axis, an impeller according to any one of the above aspects attached to the rotating shaft, and a casing which covers the impeller from the outside.

According to one or more embodiments of the configuration described above, it is possible to provide a centrifugal compressor having sufficient durability and compression performance.

According to a sixth aspect of the present invention, an impeller includes a disk formed in a disk shape about an axis and a plurality of blades provided at intervals in a circumferential direction on one side in the axial direction of the disk and configured to define a flow path extending from one side in the axial direction toward a radial outer side, wherein the blades include a first low-rigidity region which includes an inlet of the extending region of the flow path and has a relatively small inclination angle with respect to the disk, a high-rigidity region adjacent to the first low-rigidity region and having a relatively large inclination angle with respect to the disk, and a second low-rigidity region adjacent to the high-rigidity region, including an outlet of the extending region of the flow path, and having a relatively small inclination angle with respect to the disk.

According to one or more embodiments of the configuration described above, a rigidity difference is generated between the high-rigidity region and the first low-rigidity region and between the high-rigidity region and the second low-rigidity region. Due to the differences in rigidity, when bending stress is applied to the blades, most of the bending stress can be received in the high-rigidity region.

According to a seventh aspect of the present invention, the impeller according to the sixth aspect may include a cover which covers the plurality of blades from one side in the axial direction.

According to one or more embodiments of the configuration described above, the blades are supported from both sides in the axial direction by the disk and the cover. Thereby, the rigidity of the blades can be further enhanced.

According to an eighth aspect of the present invention, the centrifugal compressor according to the sixth or seventh aspect includes a rotating shaft configured to rotate about an axis, an impeller according to any one of the above aspects attached to the rotating shaft, and a casing which covers the impeller from the outside.

According to one or more embodiments of the configuration described above, it is possible to provide a centrifugal compressor having sufficient durability and compression performance.

According to one or more embodiments of the configuration described above, it is possible to provide an impeller and a centrifugal compressor which have sufficient rigidity and compression performance.

DETAILED DESCRIPTION OF EMBODIMENTS

Hereinafter, embodiments of the present invention will be described with reference to the drawings.

Figure 1:
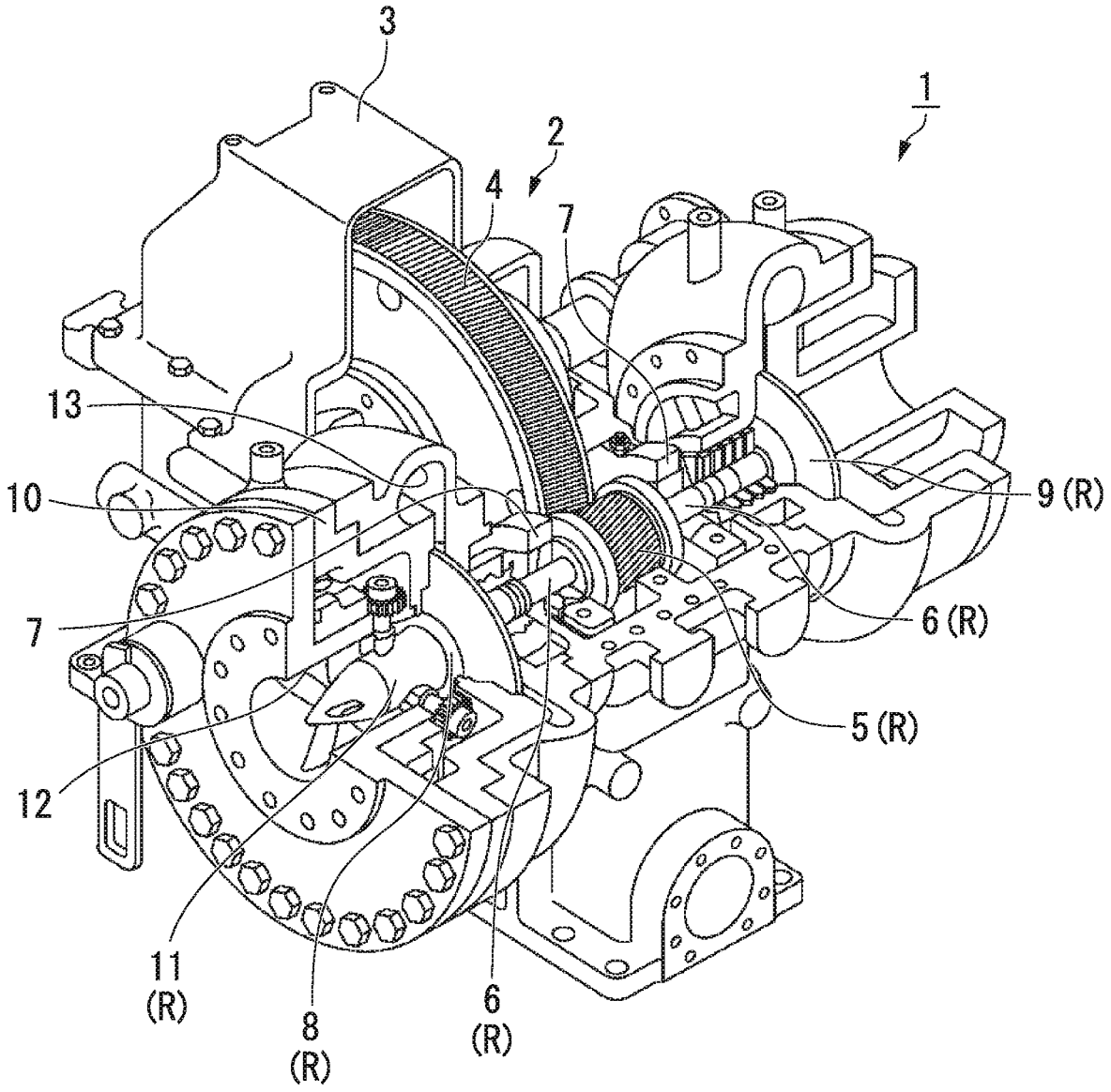
FIG. 1 is a view illustrating a configuration of a centrifugal compressor (geared centrifugal compressor) according to one or more embodiments of the present invention.

As illustrated in FIG. 1, a centrifugal compressor 1 is a so-called geared compressor with which a speed increasing mechanism 2 is equipped. The speed increasing mechanism 2 may include a gear 4 which is rotatably driven by a driving source (not illustrated) and covered with an exterior portion 3. A pinion 5, which is a gear sufficiently smaller than the gear 4, is meshed with the gear 4. The pinion 5 is fixed to a central portion in a longitudinal direction of a pinion shaft 6 rotatably supported by a bearing 7.

Each of impellers 8 and 9 are attached to opposite ends of the pinion shaft 6 in one or more embodiments. These impellers 8 and 9 are cantilevered with respect to the bearing 7. Each of the impellers 8 and 9 compresses a fluid supplied from an upstream-side flow path (not illustrated) using a centrifugal force by rotation of the pinion shaft 6 and flows the compressed fluid.

Figure 2:
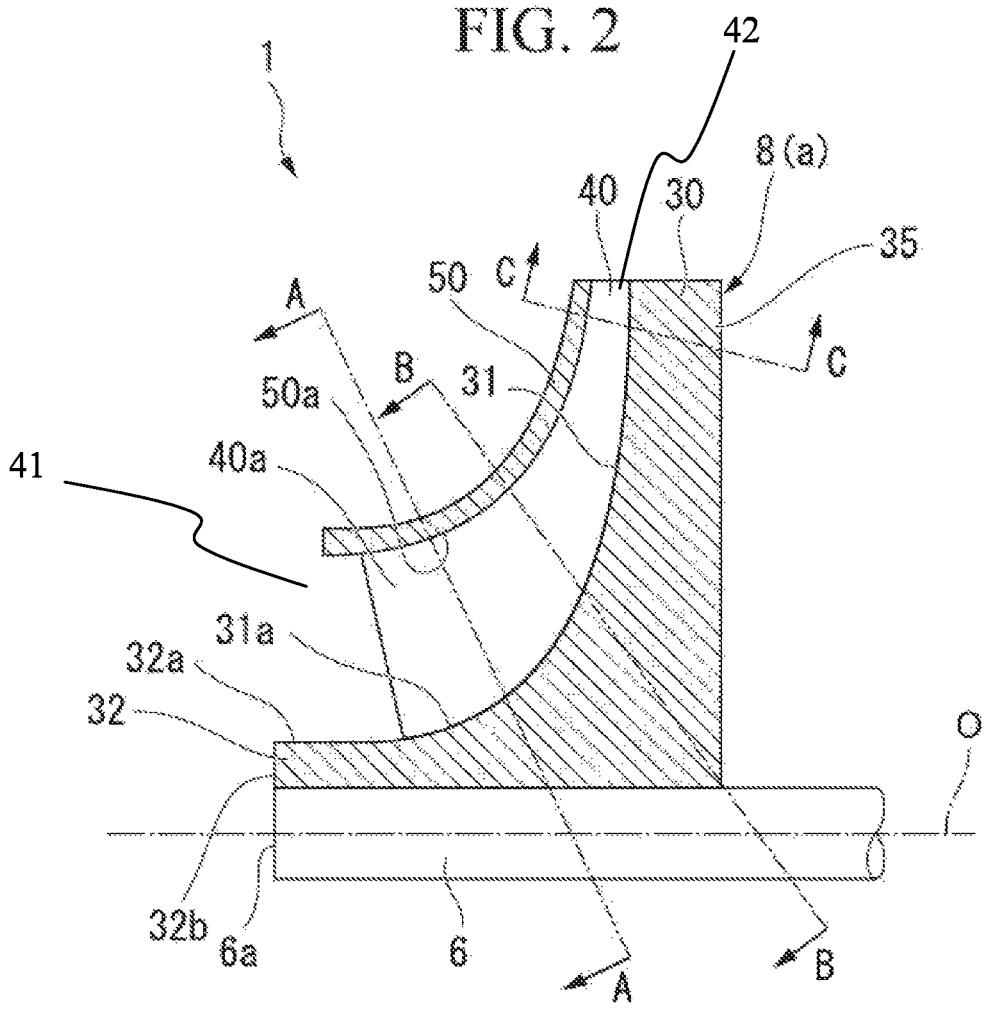
FIG. 2 is an enlarged view illustrating a main portion of an impeller according to one or more embodiments of the present invention.

A casing 10 is formed with an suction passage 12 through which a fluid is introduced from the upstream-side flow path and a discharge passage 13 through which the fluid is flows out to the outside. In addition, on an outer side in an axis O direction of the impellers 8 and 9, a lid portion 11 is disposed in a central portion of an internal space of the suction passage 12. Here, the impellers 8 and 9, the pinion shaft 6, the lid portion 11, and the pinion 5 constitute a rotor R of one or more embodiments. In FIG. 2, an alternate long and short dash line indicates the axis O.

With the configuration of the centrifugal compressor 1 as above, when the pinion shaft 6 rotates via the speed increasing mechanism 2, a fluid introduced into the suction passage 12 is compressed by the impellers 8 and 9. Thereafter, the compressed fluid is discharged to the outside of the casing 10 via the discharge passage 13 on a radial outer side of the impellers 8 and 9. Since the impellers 8 and 9 have the same shape, only the impeller 8 will be described in detail in the following description. In the following description of the impeller 8, with respect to the axis O of the pinion shaft 6, a side in which a fluid is introduced is referred to as an inlet 41 (inlet side) and the opposite side is referred to as an outlet 42 (outlet side). Further, unless otherwise described in the following description, a "radial direction" refers to a radial direction of the impellers 8 and 9, and an "axis O direction" refers to an axis O direction of the rotor R.

Figure 6:
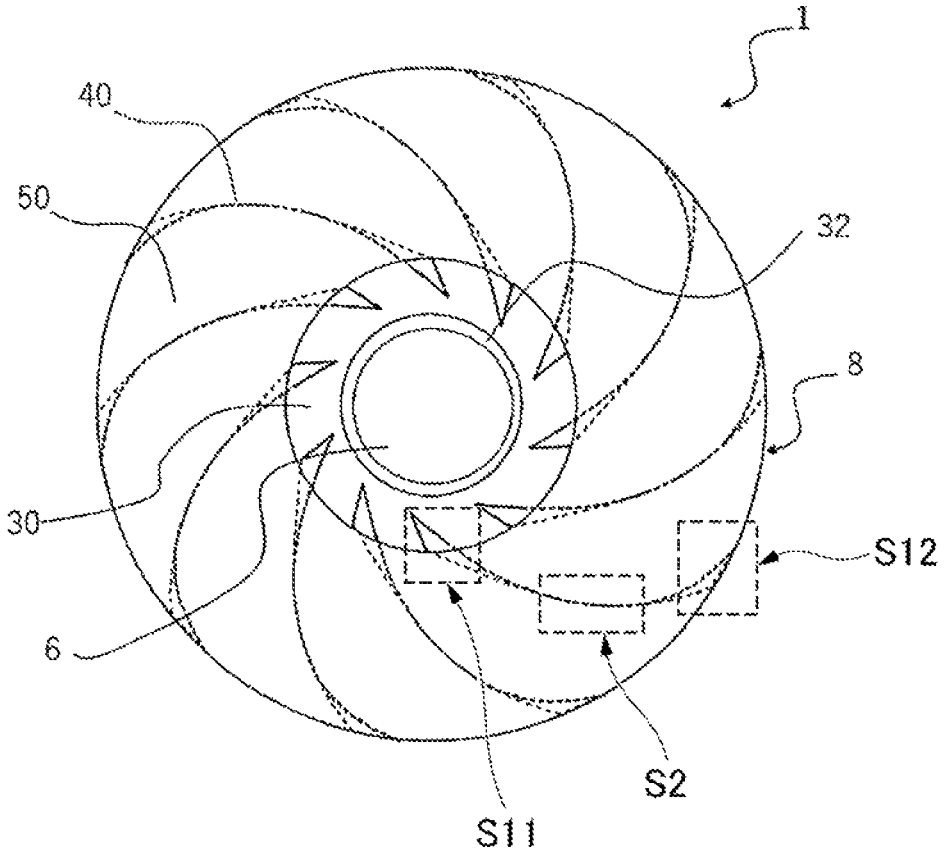
FIG. 6 is a view of the centrifugal compressor according to one or more embodiments of the present invention when viewed from an axial direction.

FIG. 2 illustrates a meridional plane of the impeller 8. The meridional plane of the impeller 8 means a longitudinal cross section passing through a meridian of the impeller 8 which has a circular shape when viewed from the front and the axis of the pinion shaft 6. FIG. 6 illustrates the impeller 8 of the centrifugal compressor 1 when viewed from the axis O direction. As illustrated in FIGS. 2 and 6, the impeller 8 of the centrifugal compressor 1 includes a disk 30 formed in a disk shape around the axis O, a plurality of blades 40, and a cover 50. The centrifugal compressor 1 is a so-called closed type impeller. The disk 30 is fixed to the pinion shaft 6 by shrink fitting or the like.

The plurality of blades 40 are provided to protrude from a front side surface (a surface on one side in the axis O direction) 31 of the disk 30. Further, these blades 40 gradually curve from one side in a circumferential direction toward the other side when viewed from the axis O direction.

The cover 50 is formed in a front end of the blades 40 and has an annular shape when viewed from the front. Therefore, the cover 50 covers the plurality of blades 40 from one side in the axis O direction.

The disk 30 includes a substantially cylindrical tubular portion 32 into which the pinion shaft 6 is fitted. The disk 30 includes a disk-shaped disk main body portion 35 extending toward the radial outer side from the tubular portion 32 on a rear side in the axial direction. The disk main body portion 35 is formed to be thicker toward a radial inner side. The disk main body portion 35 includes a concave-shaped curved surface 31*a* which smoothly connects a front side surface 31 and an outer circumferential surface 32*a* of the tubular portion 32. The above-described lid portion 11 (see FIG. 1) covers an end face 32*b* of the tubular portion 32 and an end face 6*a* of the pinion shaft 6 from the outside in the axial direction.

The plurality of blades are arranged at regular intervals in a circumferential direction of the disk main body portion 35. The blade 40 is formed to gradually taper from a radial inner side toward a radial outer side in a side view. In other words, the extending dimension (blade height) of the blade 40 with reference to the front side surface 31 and the curved surface 31*a* gradually decreases from the radial inner side of the axis O toward the radial outer side.

A flow path of the impeller 8 is defined by the front side surface 31, the curved surface 31*a*, the outer circumferential surface 32*a*, surfaces 40*a* of the blades 40 facing each other in the circumferential direction, and a wall surface 50*a* of the cover 50 facing the front side surface 31 and the curved surface 31*a*.

Figure 3A:
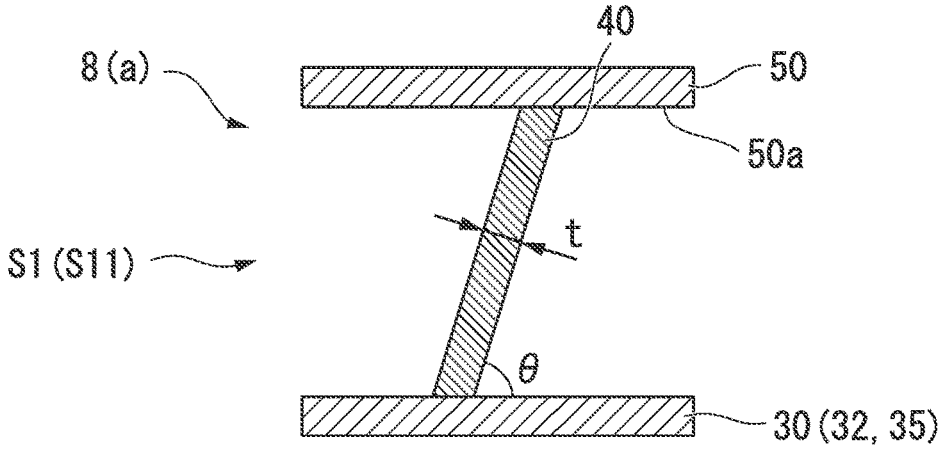
FIG. 3A is a cross-sectional view of an impeller according to one or more embodiments of the present invention and is a cross-sectional view taken along line A-A of FIG. 2.
Figure 3B:
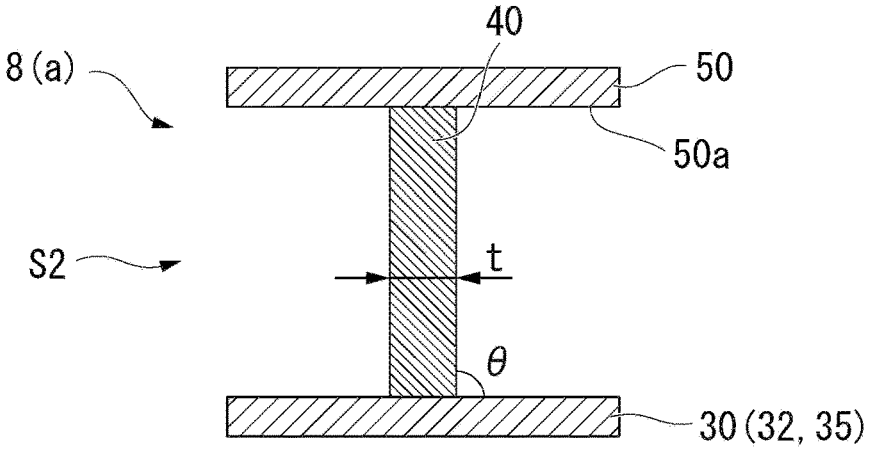
FIG. 3B is a cross-sectional view of the impeller according to one or more embodiments of the present invention and is a cross-sectional view taken along line B-B of FIG. 2.

Next, a detailed shape of the blades 40 in one or more embodiments will be described with reference to FIGS. 3A to 3C. These figures illustrate cross sections of the blade 40 when viewed from its extending direction (fluid flow direction). In these, FIG. 3A illustrates a cross section of the blade 40 taken along line A-A in FIG. 2, and FIG. 3B illustrates a cross section of the blade 40 taken along line B-B of FIG. 2. Further, FIG. 3C illustrates a cross section of the blade 40 taken along line C-C of FIG. 2.

Figure 3C:
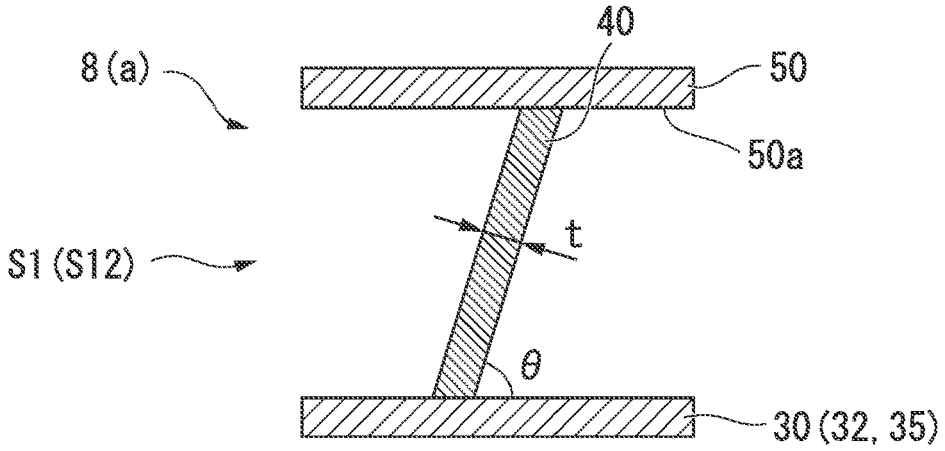
FIG. 3C is a cross-sectional view of the impeller according to one or more embodiments of the present invention and is a cross-sectional view taken along line C-C of FIG. 2.

First, as illustrated in FIGS. 3A and 3C, in a region including the inlet 41 and the outlet 42 of the impeller 8, the blade 40 is inclined toward one side in the circumferential direction with respect to the front side surface 31 and the curved surface 31*a*. On the other hand, as illustrated in FIG. 3B, at a center portion of the impeller 8, the blade 40 is substantially perpendicular to the front side surface 31 and the curved surface 31*a*. In addition, of the angles formed by the blade 40 with respect to the front side surface 31 and the curved surface 31*a*, an inferior angle (smaller angle) is referred to as an inclination angle θ of the blade 40.

That is, in the blades 40 according to one or more embodiments, the inclination angle θ in the region including the inlet 41 and the outlet 42 is set to be relatively small as compared with the inclination angle θ of the blades 40 in other regions. Further, in the above-described region, in addition to the configuration that the inclination angle θ is set to be relatively small, a plate thickness t is also relatively small as compared with a plate thickness t in other regions.

As described above, in the region (low-rigidity region S1) in which the inclination angle θ and the plate thickness t are set to be relatively small, the rigidity against a bending stress applied to the blade 40 from its height direction is relatively small. More specifically, the region on the inlet 41 side of the blade 40 is referred to as a first low-rigidity region S11, and the region on the outlet 42 side is referred to as a second low-rigidity region S12.

On the other hand, in the region other than the low-rigidity region S1, since the inclination angle θ and the plate thickness t are set to be relatively large as compared with those respective values in the low-rigidity region S1, the rigidity against the above-described bending stress is relatively large. This region is referred to as a high-rigidity region S2.

More specifically, the low-rigidity region S1 includes a region of approximately 5 to 45% in a flow direction of a fluid from the inlet 41 or the outlet 42 in an extending region of the flow path of the impeller 8. In other words, the high-rigidity region S2 is a region ranging from 5 to 100% maximally when viewed from the inlet 41 or the outlet 42, or a region ranging from 45 to 55% minimally. That is, in one or more embodiments, a central region in an extending direction of the blades 40 (fluid flowing direction) is the high-rigidity region S2.

According to one or more of the above embodiments, in the high-rigidity region S2 of the blades 40, the plate thickness t is set to be relatively large and the inclination angle θ with respect to the disk 30 is set to be relatively large. That is, the plate thickness t and the inclination angle θ change over the entire extending region of the flow path of the impeller 8. Thereby, the rigidity can be further enhanced in a state in which the plate thickness t is made relatively thin, for example, as compared with a case in which only the plate thickness t is increased. In other words, in enhancing the rigidity of the blades 40, it is possible to suppress degradation of compression performance or the like caused by excessively increasing the plate thickness t.

Further, according to the above-described configuration, a rigidity difference is generated between the high-rigidity region S2 and the low-rigidity region S1. Due to this rigidity difference, even when a bending stress is applied to the blade 40, most of the bending stress can be concentrated on the high-rigidity region S2.

Here, during an operation of the centrifugal compressor 1, a fluid at a relatively low pressure before being compressed flows in the flow path of the impeller 8. On the other hand, a compressed fluid at a high pressure flows outside of the cover 50 and the disk 30. Due to a pressure difference between the high pressure fluid and the low pressure fluid, a compressive force may be generated from both sides in the axis O direction with respect to the impeller 8. The compressive force is applied as the bending stress to the blade 40 via the cover 50 and the disk 30.

However, according to the configuration described above, since most of the bending stress can be selectively received in the high-rigidity region S2, it is possible to reduce an influence of the bending stress on durability of the blades 40. In addition, since the plate thickness t can be made relatively thin in the low-rigidity region S1 corresponding to the inlet 41 and the outlet 42 of the impeller 8, the compression performance of the centrifugal compressor 1 can also be enhanced.

Embodiments of the present invention have been described above with reference to the drawings. However, various modifications can be made to the above-described configurations without departing from the scope of the present invention.

In the above-described embodiments, for example, the high-rigidity region S2 and the low-rigidity region S1 are formed by changing the inclination angle θ and the plate thickness t of the blade 40 at each portion of the blades 40.

However, the configuration of the high-rigidity region S2 and the low-rigidity region S1 are not limited thereto. As an example, as illustrated in FIG. 4, the high-rigidity region S2 and the low-rigidity region S1 may be formed by changing a curvature at each portion in the extending direction of the blades 40.

Figure 4:
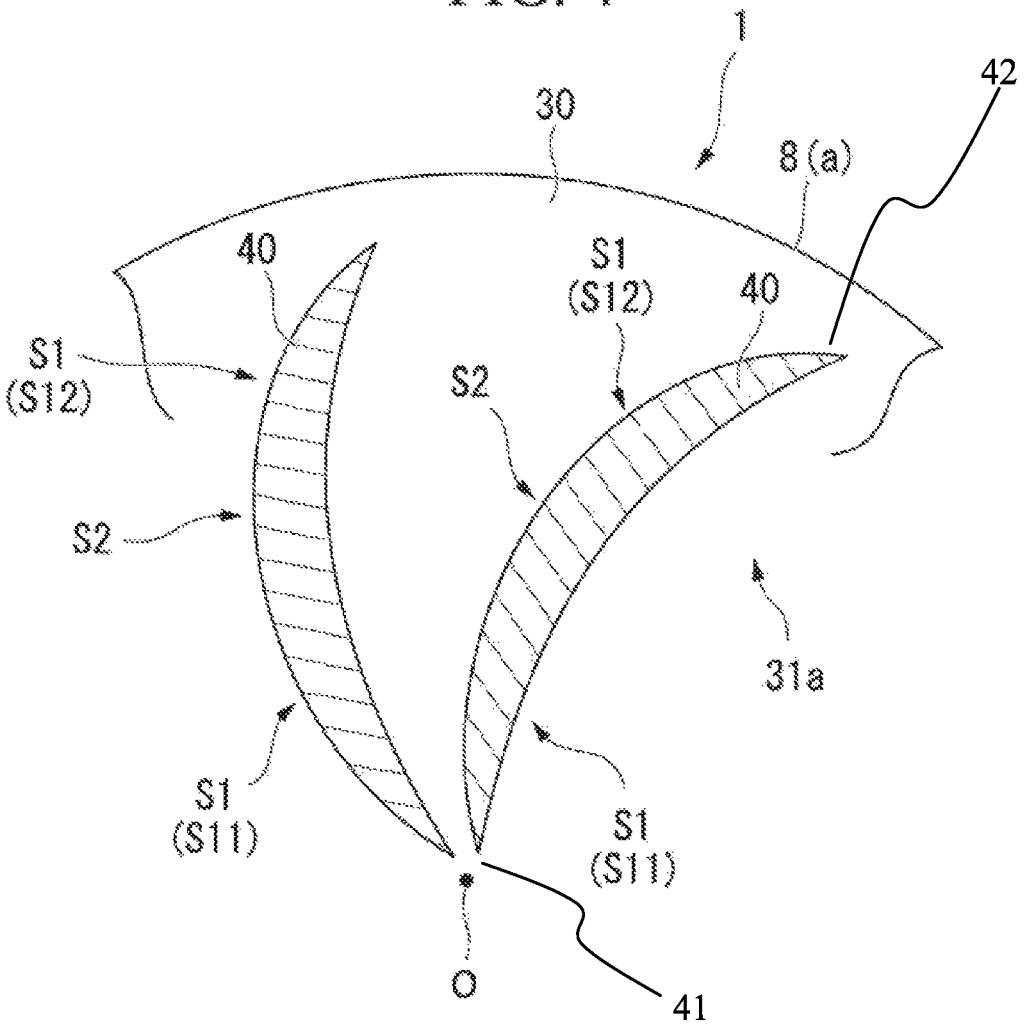
FIG. 4 is a view of blades according to a modified example of one or more embodiments of the present invention when viewed from an axial direction.

More specifically, as illustrated in FIG. 4, in the region including the inlet 41 and the outlet 42 of the blade 40, the low-rigidity region S1 is formed by setting the curvature of the blade 40 when viewed from the axis O direction to be relatively small as compared with the other region. On the other hand, the region excluding the inlet 41 and the outlet 42 of the blade 40 sets the curvature of the blade 40 to be relatively large so that the region is set to be the high-rigidity region S2.

It is known that the rigidity of the blades 40 decreases as the curvature when viewed from the axis O direction decreases, and increases as the curvature increases. Therefore, according to the configuration described above, it is possible to form the high-rigidity region S2 and the low-rigidity region S1 on the basis of magnitude of the curvature. Thereby, it is possible to enhance the rigidity without increasing the plate thickness t of the blade. In addition, in the low-rigidity region S1 corresponding to the inlet 41 and the outlet 42 of the impeller 8, since the plate thickness t can be made relatively thin, the compression performance of the centrifugal compressor 1 can also be enhanced.

Further, in the above-described embodiments, the impeller 8 has been described as having the cover 50. That is, the impeller 8 is a so-called closed type. However, the impeller 8 may not necessarily include the cover 50 and may be configured as a so-called open type.

In the open type impeller 8, since the blade 40 is supported in a cantilever state with respect to the disk 30, a more positive countermeasure against the bending stress caused by the pressure difference of the fluid is required. Therefore, by providing the high-rigidity region S2 and the low-rigidity region S1 as described above in the blade 40, a large contribution to durability enhancement can be obtained.

In the above-described embodiments, the configuration in which the first low-rigidity region S11, the high-rigidity region S2, and the second low-rigidity region S12 are provided from the inlet 41 side to the outlet 42 side in the extending direction of the blades 40 has been described. However, it is also possible to set either one of the inlet 41 side or the outlet 42 side as the low-rigidity region S1 and set the remaining regions as the high-rigidity region S2.

Figure 5A:
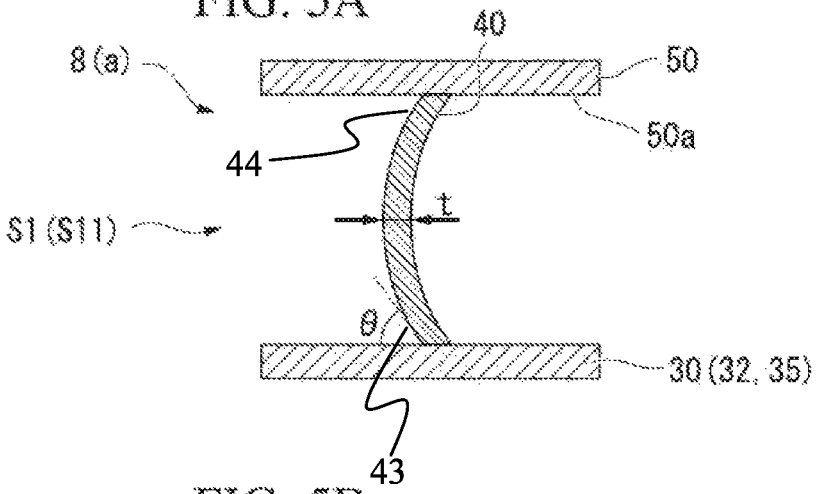
FIG. 5A is a cross-sectional view of an impeller according to one or more embodiments of the present invention and is a cross-sectional view taken along line A-A of FIG. 2.
Figure 5B:
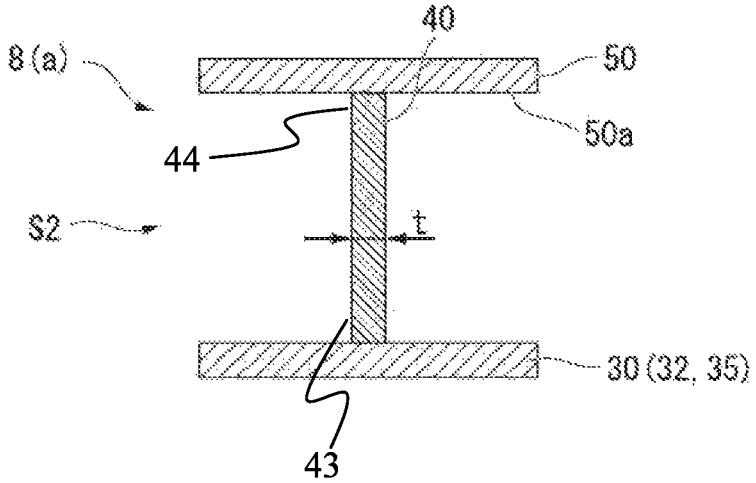
FIG. 5B is a cross-sectional view of the impeller according to one or more embodiments of the present invention and is a cross-sectional view taken along line B-B of FIG. 2.
Figure 5C:
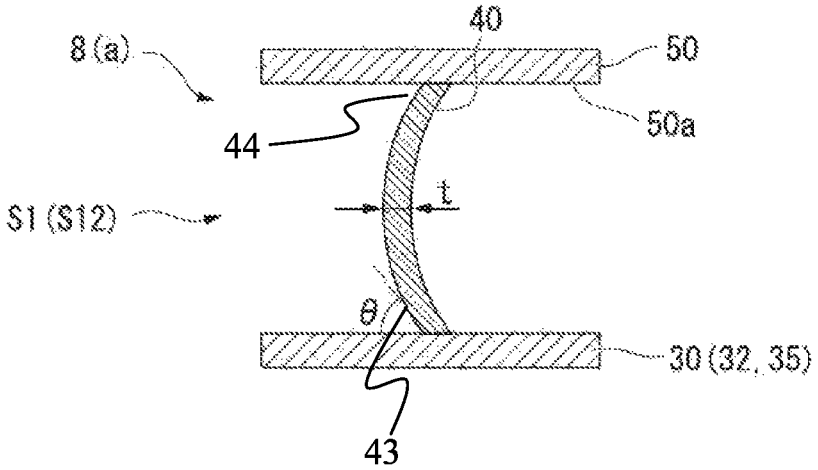
FIG. 5C is a cross-sectional view of the impeller according to one or more embodiments of the present invention and is a cross-sectional view taken along line C-C of FIG. 2.

Next, additional embodiments of the present invention will be described with reference to FIGS. 5A to 5C. These figures illustrate cross sections of a blade 40 when viewed from its extending direction (fluid flow direction). Among these, FIG. 5A illustrates a cross section of the blade 40 taken along line A-A of FIG. 2, and FIG. 5B illustrates a cross section of the blade 40 taken along line B-B of FIG. 2. Further, FIG. 5C illustrates a cross section of the blade 40 taken along line C-C of FIG. 2. Configuration parts the same as those in the embodiments described above will be denoted with the same reference signs and detailed description thereof will be omitted.

As illustrated in FIGS. 5A and 5C, in a low-rigidity region S1 of the blade 40 in one or more embodiments, among opposite end edges in a height direction, an end edge 43 on a disk 30 side is inclined with respect to a front side surface 31 and a curved surface 31*a* with an inclination angle θ.

Further, in one or more embodiments, an end edge 44 on a side in contact with the cover 50 is also inclined with respect to the cover 50. In addition, the blade 40 is smoothly curved from the disk 30 side toward the cover 50 side. More specifically, in the low-rigidity region S1, the blade 40 protrudes in a curved surface shape from a front side to a rear side in a rotation direction of a pinion shaft 6. Further, the protrusion direction of the blade 40 is not limited to the above, and may be a direction opposite to the above, that is, a protrusion in a curved surface shape from the rear side to the front side in the rotation direction.

On the other hand, in a high-rigidity region S2 adjacent to the low-rigidity region S1, as illustrated in FIG. 5B, the blade 40 is substantially perpendicular to the disk 30 and the cover 50. Further, in the high-rigidity region S2, a plate thickness t of the blade 40 is set to be relatively thick as compared with a plate thickness t in the low-rigidity region S1.

According to one or more of the embodiments described above, since most of the bending stress applied to the blade 40 can be selectively received in the high-rigidity region S2, it is possible to reduce the influence of the bending stress on the durability of the blade 40. In addition, since the plate thickness t can be made relatively thin in the low-rigidity region S1 corresponding to the inlet 41 and the outlet 42 of the impeller 8, compression performance of the centrifugal compressor 1 can also be enhanced.

An example in which the impeller 8 (9) according to one or more embodiments of the present invention is applied to a geared compressor serving as the centrifugal compressor 1 has been described above. However, the configuration of the centrifugal compressor 1 is not limited to the geared compressor. For example, it is possible to apply a multistage compressor as the centrifugal compressor 1 as a matter of course.

INDUSTRIAL APPLICABILITY

According to the configuration described above, it is possible to provide an impeller and a centrifugal compressor which have sufficient durability and compression performance.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1 Centrifugal compressor
2 Speed increasing mechanism
3 Exterior portion
4 Gear
5 Pinion
6 Pinion shaft
7 Bearing
8, 9 Impeller
10 Casing
11 Lid portion
12 Suction passage
13 Discharge passage
30 Disk
31 Front side surface
32 Tubular portion
35 Disk main body portion
40 Blade
41 Inlet

42 Outlet
43 End edge on disk 30 side
44 End edge on side in contact with cover 50
50 Cover
31*a* Curved surface
32*a* Outer circumferential surface
40*a* Surface
50*a* Wall surface
O Axis
R Rotor
S1 Low-rigidity region
S11 First low-rigidity region
S12 Second low-rigidity region
S2 High-rigidity region
t Plate thickness
θ Inclination angle

The invention claimed is:

1. An impeller comprising:

a disk formed in a disk shape about an impeller axis; and a plurality of blades provided at intervals in a circumferential direction on one side of the disk, the plurality of blades defining a flow path that extends from the one side of the disk in an axial direction of the disk toward a radial outer portion of the disk, wherein each of the plurality of blades includes a first low-rigidity region, a second low-rigidity region, and a high-rigidity region, the first low-rigidity region is located at an inlet of an extending region of the flow path, the second low-rigidity region is located at an outlet of the extending region of the flow path, the high-rigidity region is located at a central portion of each of the plurality of blades between the first low-rigidity region and the second low-rigidity region, the first low-rigidity region and the second low-rigidity region have a same plate thickness that is smaller than that of the high-rigidity region, and each of the first low-rigidity region and the second low-rigidity region is attached to the disk with a same inclination from a direction perpendicular to the disk that is smaller than that of the high-rigidity region which is attached perpendicular to the disk.

2. The impeller according to claim 1, wherein a curvature in a radial direction of each of the plurality of blades when viewed from the impeller axis is smaller in the first low-rigidity region and the second low-rigidity region than in the high-rigidity region.

3. The impeller according to claim 1, further comprising a cover that covers the plurality of blades in the axial direction.

4. A centrifugal compressor comprising:

an impeller according to claim 1 attached to a rotating shaft, the rotating shaft configured to rotate about the impeller axis; and a casing that covers the impeller.

5. An impeller comprising:

a disk formed in a disk shape about an impeller axis; and a plurality of blades provided at intervals in a circumferential direction on one side of the disk, the plurality of blades defining a flow path that extends from the one side of the disk in an axial direction of the disk toward a radial outer portion of the disk, wherein each of the plurality of blades includes a first end region, a central region, and a second end region, the first end region includes an inlet of an extending region of the flow path and has a first absolute value of a first inclination angle with respect to the disk at an edge where the first end region is attached to the disk, the central region is adjacent to the first end region and has a second absolute value of a second inclination angle with respect to the disk, the second end region is adjacent to the central region, includes an outlet of the extending region of the flow path, and has the first absolute value of the first inclination angle with respect to the disk at an edge where the second end region is attached to the disk, and the first absolute value is smaller than the second absolute value.

6. The impeller according to claim 5, further comprising a cover which covers the plurality of blades in the axial direction.

7. A centrifugal compressor comprising:

an impeller according to claim 6 attached to a rotating shaft, the rotating shaft configured to rotate about the impeller axis; and a casing that covers the impeller.

* * * * *